United States Patent [19]

Eang et al.

[11] 4,135,560

[45] Jan. 23, 1979

[54] APPARATUS FOR FILLING BULK MATERIAL CONTAINERS

[75] Inventors: Tan H. Eang, Bridgewater; John O. McDonald, Englishtown; Kenneth C. Yi, Belle Mead, all of N.J.

[73] Assignee: Union Carbide Corporation, New York, N.Y.

[21] Appl. No.: 752,877

[22] Filed: Dec. 20, 1976

[51] Int. Cl.[2] ..... B65B 1/04

[52] U.S. Cl. ..... 141/198; 141/392; 239/666

[58] Field of Search ..... 141/93, 94, 95, 192–229, 141/129–191, 250–284, 392; 239/666; 193/3; 198/640, 641, 642; 214/17 CD

[56] References Cited

U.S. PATENT DOCUMENTS

| | | | |
|---|---|---|---|
| 2,360,756 | 10/1944 | Briggs | 141/392 |
| 2,956,810 | 10/1960 | Voich et al. | 239/666 |
| 3,738,464 | 6/1973 | Ortup et al. | 141/392 |

*Primary Examiner*—Houston S. Bell

*Attorney, Agent, or Firm*—Gerald R. O'Brien, Jr.

[57] ABSTRACT

Method and apparatus are disclosed for feeding and distributing, in a container of varying configuration, bulk materials comprising: inlet positioned near the top of said container; at least partially radially-compartmented rotor positioned below; and material-deflecting stator fixedly positioned around the periphery of said rotor and mounted for permitting preselected orientation of said stator with respect to said rotor.

3 Claims, 5 Drawing Figures

FIG. 1
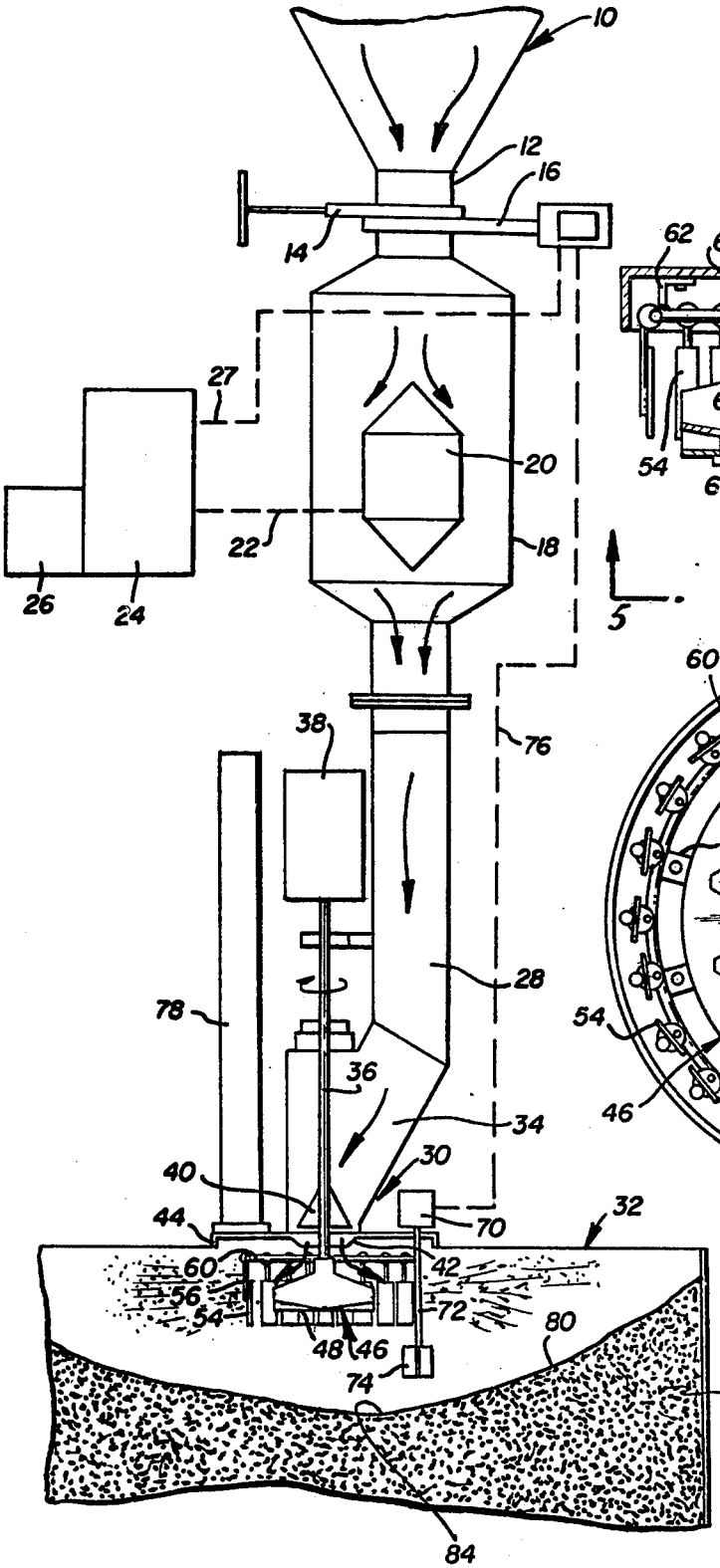
FIG. 4
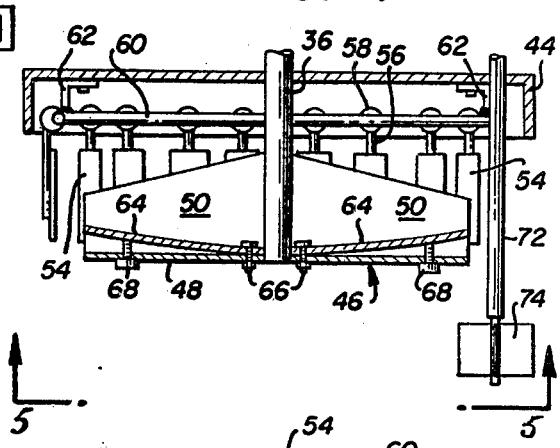
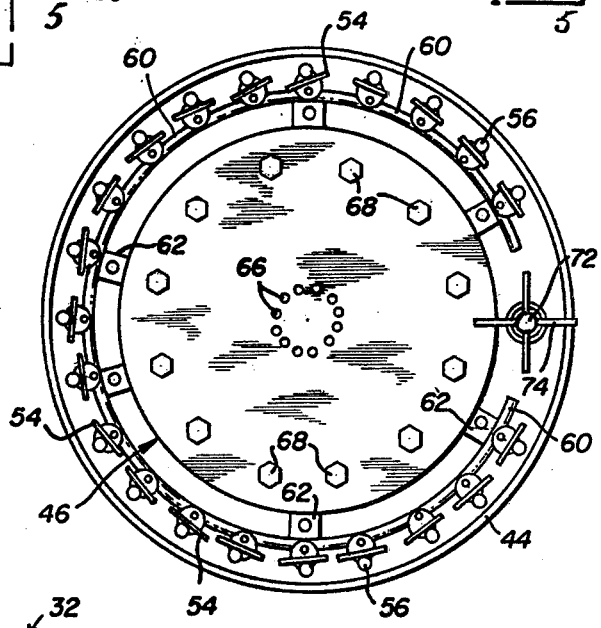
FIG. 5

APPARATUS FOR FILLING BULK MATERIAL CONTAINERS

The present invention relates to method and apparatus for filling bulk material containers and, more particularly, to such method and apparatus for feeding and distribution of material within said containers regardless of the configuration of the containers.

Heretofore, considerable effort has been directed to providing method and apparatus for the feeding and distribution of bulk materials within containers, but relatively little effort has been directed to such filling and distribution within containers having asymmetrical interiors. While it is relatively simple to fill, with good material distribution, the interior of a clear cylindrical or spherical material container, it is quite difficult to fill, with good material distribution, the interior of an internally-reinforced container or one having an asymmetrical interior shape.

Many modern bulk containers have asymmetrical interior shapes and internal reinforcing members which are occasioned by the modern requirements for storage, filling and intermodal containerized transportation.

Therefore, the prime object of the present invention is to provide method and apparatus for the efficient feeding and distribution of bulk materials into containers without regard to the internal symmetry of the containers.

Other aims, advantages and objects will be apparent from the following description and appended claims.

As employed herein, the term "container" means relatively large, rigid enclosures, bins or boxes (e.g. silos, hopper cars, van boxes and the like) having either symmetric or asymmetric configurations by shape or volume, relative to the point of filling of such container; and "bulk materials" means the wide range of particle size, shape and density of solid material which may extend from powders, granules, pellets, to small chunks.

In accordance with one aspect of the invention, apparatus for feeding and distributing in a container of varying configuration bulk materials comprising: material inlet means positioned near the top of said container; at least partially radially-compartmented rotor means horizontally positioned below; and material-deflecting stator means fixedly positioned vertically around the periphery of said rotor means and mounted through means for permitting preselected orientation of said stator means with respect to said rotor means.

In accordance with another aspect of the invention, a method is provided for charging to maximum volumetric capacity containers of varying configuration with bulk materials comprising: conveying said material from feeding means to inlet and distributor means positioned within said container near the top thereof; and feeding said material to successive radially-compartmented sectors of rotating distributor means having upwardly-inclined bases for imparting both outward and upward forces to said material being distributed to fill said container to a level, around the outer sides thereof, above that of said distributor means.

In the drawings:

FIG. 1 is a schematic elevational view, portions thereof being in section, of a bulk material feeding and distribution system embodying the invention;

FIG. 4 is an elevational view, partially in section, showing the detailed construction of combined rotor means, material-deflecting stator means and sensor means employed in the present invention; and FIG. 5 is a bottom view of the combined means of FIG. 4, taken along the line 5—5 below the bottom of the sensor means.

Figure 2:
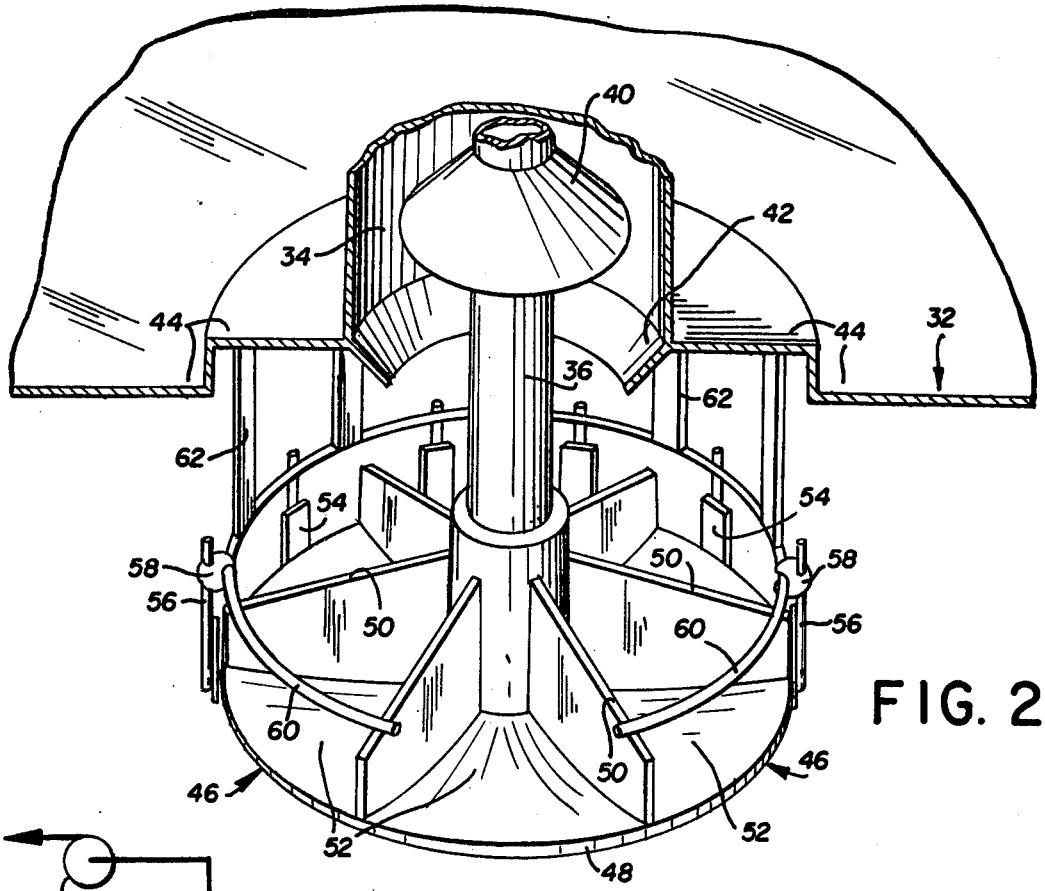
FIG. 2 is a perspective view, portions thereof being in section, of inlet and radially-compartmented rotor means of the invention.

Referring specifically to the apparatus embodiments of the drawings, bulk material is conveyed in a stream by gravity from a surge bin 10 through conduit 12 containing valve means 14 and 16. Valve means 14 comprises a manual control valve and valve means 16 a pneumatic, actuated on-off valve.

From conduit 12, the bulk material stream passes through chamber 18 containing mass rate sensor 20 which is electrically connected through line 22 to preset batch counter, integrator and recorder 24 which is, in turn, connected to printer 26. An electrical feedback loop is established through line 27 from the integrator 24 to the control of pneumatic valve 16.

From chamber 18 the bulk material stream passes through gravity chute 28 to the material feeding and distribution assembly 30 which is positioned immediately above and within the top of container 32.

The feeding and distribution assembly 30 comprises an upper chamber 34 through which the bulk material stream passes. Also passing through chamber 34 is rotating shaft 36 driven by motor 38. Positioned on shaft 36 in the chamber 34 is an outwardly-flaring rotating cone 40. A stationary hopper 42 is positioned at the end of gravity chute 28 at approximately the top 44 of container 32. The bulk material stream, feeding under gravity through chute 28 into the system, first encounters a combination of rotating cone 40 and stationary hopper 42 at the end of the chute which is designed to reduce the vertical momentum of the material before feed into the next stages of the system. This combination is also designed to ensure uniform feed of material in all azimuthal directions onto the rotor.

Secured to the lower end of shaft 36 is rotor means 46 having a horizontal base 48 and compartmented by radially-positioned, vertical dividers 50 into a plurality of sectors 52.

Bulk material is fed to rotor 46 of the distributor means near the center thereof and propelled by centrifugal force away from the rotor. Modification of the direction of propulsion of the bulk material from the rotor is controlled by the positioning of a plurality of stator blades 54 around the periphery of the rotor 46. The stator blades 54 are secured to shafts 56 which are, in turn, held by gimbal clamps 58. The gimbal clamps 58 are secured to retaining ring 60 which is held through support members 62 to the filling hatch cover or top 44 of container 32.

The base 48 of rotor means 46 may be upwardly inclined toward its periphery as shown in FIG. 2 of the drawings. Alternatively, as shown in the embodiment of FIGS. 4 and 5 of the drawings, the lower portion of each sector compartment 52 of the rotor means 46 may be provided on its base 48 with plates 64 which are secured to the base 48 of each sector 52 by means 66 and are adjustable in incline by adjustment of set screw means 68. Both embodiments will provide rotor means which impart an outward and upward component force to the material particle stream.

Electrical level sensing means 70 are provided above the top 44 of container 32 and is shafted through member 72 to rotating sensor vane member 74 which detects the level of bulk material within the container 32. When the pre-set level is attained, sensing means 70 actuates valve 16 through line 76 to stop the stream of bulk material.

Dust collector means 78 are provided in the top 44 of container 32 and serves to collect dust by the venting of gas therethrough.

It has been found that the ability, through use of the present invention, to fill containers, while employing variable distribution patterns for the bulk materials being charged to the containers, enables not only the easier filling of containers of asymmetrical shape and volume, but also permits the more complete filling of any container. The inverted conical shape 80 of the top of the bulk material 82 within the container is attained due to the propelling of the bulk material particles from the rotor means. The lowest point 84 of bulk material level, upon filling, will be the point in the vicinity of the level sensor means. It has been found that closed hopper car containers, regardless of internal shape are capable of being filled in accordance with the present invention to a capacity of about 95% of the total internal volume of such containers.

Figure 3:
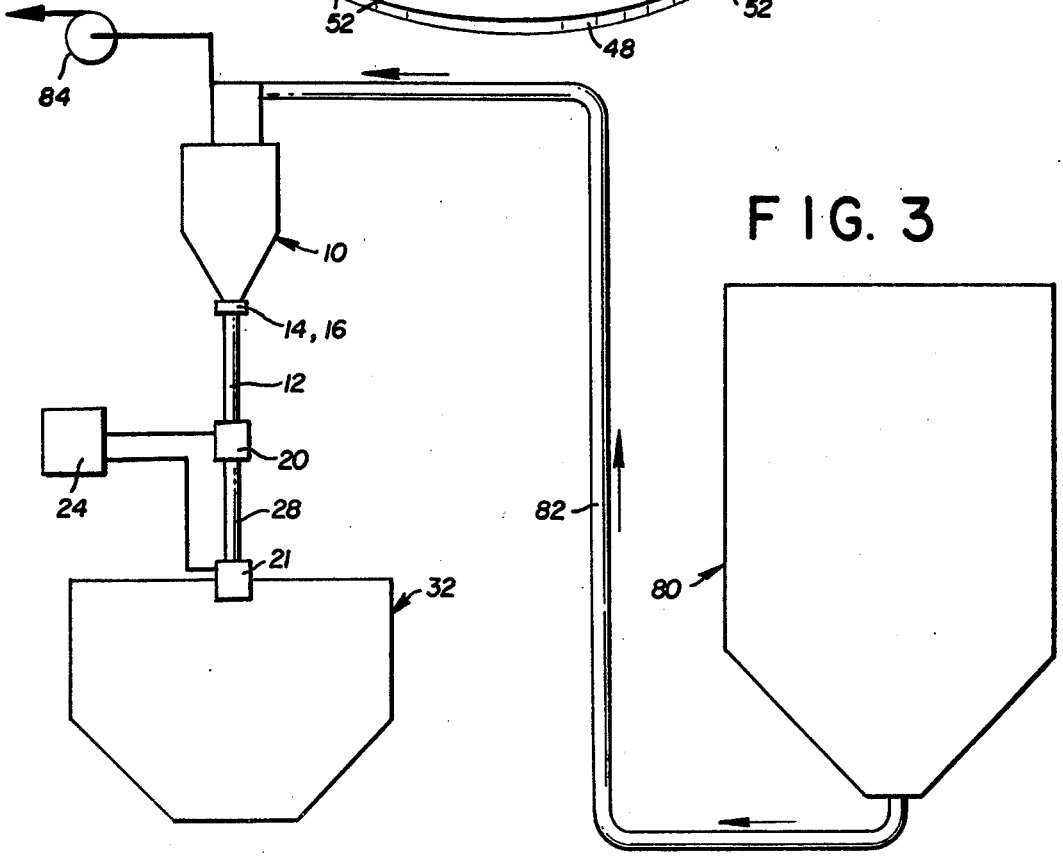
FIG. 3 is a schematic view of an entire bulk material container filling system embodying the invention.

As shown in FIG. 3 of the drawings, bulk material is passed from a large storage bin 80 (e.g. 40,000 pounds capacity) through a pneumatic conveying system, including line 82 and blower 84, to the top of surge bin 10 (e.g. 5,000 pound capacity). After passage through valves 14 and 16, conduit 12 and mass flow sensor 20, the material passes through gravity chute 28 and programmable distributor 21 to the feeding and distributing assembly 30 positioned both above the top 44 and within container 32 (e.g. 20,000 pound capacity).

In the operation of the feeding and distribution means of the invention, it is to be understood that, to provide a pattern required to fill an asymmetrical container shape, observed results in distribution may be employed to suggest the necessary distribution pattern adjustment to effect maximum filling of the container. To adjust the distribution pattern, the stator blades may be more fully opened or closed to provide the necessary deflection to produce lead or lag in departure angle of the bulk material passing from successive sector compartments of the rotor means.

It has been determined that, based on an approximate analysis of the effects of centrifugal and solid frictional forces on a particle while on the rotor, the particle leaves the rotor at a prescribed departure angle, $\lambda$, to the tangent at the point of departure from the rotor which is given from the equation:

$$\tan\lambda = \frac{0.93\sqrt{r_r - r_h}\,(\omega\sqrt{r_r + r_h} - \sqrt{2\eta g})}{\omega r_r}$$

with total velocity of discharge:

$$V = 0.93\sqrt{r_r - r_h}\,(\omega\sqrt{r_r + r_h} - \sqrt{2\eta g})$$

where:

$r_r$ = rotor radius (ft);
$\eta$ = coefficient of friction;
$r_h$ = chute hopper radius (ft);
g = gravitational acceleration;
and
$\omega$ = angular velocity of rotor (rad/sec).

There are two modes of operation of this system of the invention, both of which will substantially reduce the probability of operator error. Mode One operates when it is desired to load as much material into the container as possible. When material level reaches the position of the level sensor 74, the sensor will automatically cause the pneumatic valve to close, stopping the loading operation. Mode Two provides for the need for a prescribed quantity of material to be loaded into the container. The prescribed amount is programmed into a pre-set batch controller which will then cause the pneumatic valve to close when the integrator unit 24 perceives this desired quantity during the loading operation.

It is to be understood that, whereas the specific embodiment described herein employs a plurality of individually mounted material-deflecting stator means, other equivalent arrangements of material-deflecting stator means may alternatively be employed. For example, one may employ a metal band or ring of sheet material, suitably die cut to provide an assembly of stator elements fixedly positioned through the sheet material, each stator element being orientable by bending in the directions of its three axes. Such a stator means assembly, when curved and mounted around the periphery of said rotor means, provides the equivalent plurality of material-deflecting stator elements required. Other alternative embodiments will readily occur to those skilled in the art upon reading this specification.

In an example of the invention, high density polyethylene granular material of mean particle size 0.025 inches (Range: 0.007 inches to 0.08 inches) was loaded into a pilot plant scale "jumbo" hopper car via only one hatch per compartment. The material angle of friction was about 15° with steel. The hopper car had a four-compartment, in-line orientation with the two inner compartments measuring: 8 feet 2 inches length, 7 feet 2 inches width, and 10 feet 0 inches height; and the two end compartments measuring: 12 feet 4 inches length, 7 feet 2 inches width and 10 feet 0 inches height. The inner compartments had symmetrical bottom inverted conical hoppers 2 feet 6 inches in height, while the end compartments had asymmetrical bottom inverted conical hoppers ranging from 2 feet 6 inches to 6 feet 11 inches on opposite sides.

In this example, the gravity chute 28 was 8 inches in diameter; the base of rotating cone 40 was 5 inches in diameter; the outlet of chute hopper 42 was 7 inches in diameter; the rotor had 6 vertical dividers 50, which measured 12½ inches in diameter having its base inclined outwards and upwards at about 4° to the horizontal; the rotating shaft 36 was 1½ inches in diameter; and the hatch openings 44 of the containers were 20½ inches in diameter.

A 5 hp motor 38 was employed to drive rotor 46 at 1750 rpm. The bulk material was fed at 40,000 lbs/hour, the material particles leaving rotor at a departure angle ($\lambda$) of 38°.

It was found that, for an end compartment of volumetric capacity 650 $ft^3$, filling was effected to 94.5% of total volume. For an end compartment of volumetric capacity 560 $ft^3$, it was found that filling was effected to 97.0% of total volume. For "jumbo" hopper car (with two end and two intermediate compartments) average filling was effected to 95% of total volume. An inverted conical profile of bulk material in container was maintained during the filling process.

For these tests the materials of construction employed were:

(a) gravity chute 28, cone 40, hopper 42 and flange 44: aluminum (b) drive shaft 36: carbon steel.

(c) rotor 46 and vanes 50: 304 stainless steel - Stellite faced.

(d) stators 54: Type 304 stainless steel.

(e) bulk container walls: Carbon steel - epoxy-lined on inner surface.

(f) level sensor 74: stainless steel.

What is claimed is:

1. Apparatus for charging containers of varying configuration to maximum volumetric capacity with bulk materials comprising inlet conduit means for feeding said materials to the top of a container, rotary distributor means positioned in said conduit means, near the discharge end thereof, radially-compartmented rotor means connected to said conduit means and spaced from the discharge end thereof whereby material is received by said compartmented rotor means from said inlet means and discharged from said compartmented rotor means, a plurality of material deflecting stator means fixedly and vertically positioned around the periphery of said compartmented rotor means and each of said material deflecting stator means adapted to be oriented about its axis to be more fully opened or closed relative to said compartmented rotor means to provide the necessary deflection of material discharged from said rotor means, thereby distributing material throughout said container with the result that easier and more complete filling of containers particularly those of asymmetrical shape and volume is effected.

2. Apparatus in accordance with claim 1, wherein the base of said rotor means comprises a plurality of sectors, each having means for making them upwardly inclined from the center toward the outer periphery thereof.

3. Apparatus in accordance with claim 1, wherein said radially-compartmented rotor means is positioned in proximity with material level sensing means which are adapted to feed back a signal to arrest the flow of said material through said inlet conduit means to said container when said material level therein reaches a predetermined level.

* * * * *

UNITED STATES PATENT OFFICE

CERTIFICATE OF CORRECTION

Patent No. 4,135,560 Dated January 23, 1979

Inventor(s) Hock E. Tan, John O. McDonald, Kenneth C. Yi

It is certified that error appears in the above-identified patent and that said Letters Patent are hereby corrected as shown below:

Inventors: "Tan H. Eang" should read -- Hock Eang Tan --.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*